US010197262B2

(12) United States Patent
Sohn et al.

(10) Patent No.: US 10,197,262 B2
(45) Date of Patent: Feb. 5, 2019

(54) LED LIGHTING APPARATUS HAVING NATURAL CONVECTION-TYPE HEAT DISSIPATION STRUCTURE

(71) Applicant: SAMJIN LND Co., Ltd., Hwaseong-si, Gyeonggi-do (KR)

(72) Inventors: Choong-yong Sohn, Cheongju-si (KR); Jun-ho Song, Hwaseong-si (KR); Jin-mo Kim, Osan-si (KR)

(73) Assignee: SAMJIN LND CO., LTD., Hwaseong-Si, Gyeonggi-Do (KR)

( * ) Notice: Subject to any disclaimer, the term of this patent is extended or adjusted under 35 U.S.C. 154(b) by 10 days.

(21) Appl. No.: 15/479,798

(22) Filed: Apr. 5, 2017

(65) Prior Publication Data

US 2018/0209636 A1 Jul. 26, 2018

(30) Foreign Application Priority Data

Jan. 20, 2017 (KR) ..... 10-2017-0009996

(51) Int. Cl.
*F21V 29/75* (2015.01)
*F21V 3/00* (2015.01)
(Continued)

(52) U.S. Cl.
CPC ..... *F21V 29/75* (2015.01); *F21V 3/00* (2013.01); *F21V 17/10* (2013.01); *F21V 21/14* (2013.01);
(Continued)

(58) Field of Classification Search
CPC . F21V 29/75; F21V 29/83; F21V 3/00; F21V 17/10; F21V 21/14; F21V 23/02
(Continued)

(56) References Cited

U.S. PATENT DOCUMENTS 7,484,863 B1 * 2/2009 Aubrey ..... F21V 13/04 362/294
8,157,422 B2 * 4/2012 Paik ..... F21K 9/23 362/249.02
(Continued)

FOREIGN PATENT DOCUMENTS

JP 2015-005365 A 1/2015
KR 10-2013-0011048 A 1/2013
(Continued)

OTHER PUBLICATIONS

Notification of Reason for Refusal, 10-2017-0009996, 9-5-2017-012174818, dated Feb. 17, 2017. No English abstract translation included.

*Primary Examiner* — Bryon T Gyllstrom
(74) *Attorney, Agent, or Firm* — Lucas & Mercanti, LLP

(57) ABSTRACT

Disclosed is an LED lighting apparatus having a natural convection-type heat dissipation structure. The LED lighting apparatus includes a heat sink coupled to a back surface of a printed circuit board (PCB) to which a plurality of light emitting diode (LED) devices is mounted and, and functioning to absorb heat generated by the LED devices, in which center portions of the heat sink and the PCB are provided with openings serving as a convection hole that induces natural convection such that hot air under the heat sink rises along with rising hot air attributed to heat radiated from an upper surface of the heat sink and surrounding cooler air is supplied to the upper surface the heat sink and to around the LED devices. Due to the convection hole, the LED lighting apparatus provides a heat dissipation effect as high as that of an active cooling system.

19 Claims, 8 Drawing Sheets

(51) Int. Cl.

| | |
|---|---|
| ***F21V 23/02*** | (2006.01) |
| ***F21V 29/83*** | (2015.01) |
| ***F21V 17/10*** | (2006.01) |
| ***F21V 21/14*** | (2006.01) |
| *F21Y 115/10* | (2016.01) |

(52) U.S. Cl.
CPC ..... *F21V 23/02* (2013.01); *F21V 29/83* (2015.01); *F21Y 2115/10* (2016.08)

(58) Field of Classification Search
USPC ..... 362/249.02
See application file for complete search history.

(56) References Cited

U.S. PATENT DOCUMENTS 8,384,276 B2 * 2/2013 Hsieh ..... F21V 7/0083 313/11
8,777,455 B2 * 7/2014 Pickard ..... F21K 9/233 362/241
8,783,937 B2 * 7/2014 Steedly ..... F21V 3/049 362/249.02
2010/0014289 A1 * 1/2010 Thomas ..... F21V 15/01 362/235
2010/0026158 A1 * 2/2010 Wu ..... F21V 3/02 313/46
2010/0060130 A1 * 3/2010 Li ..... F21V 29/004 313/46
2010/0171403 A1 * 7/2010 Yang ..... F21K 9/00 313/46
2010/0309664 A1 * 12/2010 Liu ..... F21S 2/005 362/235
2011/0002118 A1 * 1/2011 Yip ..... F21V 7/0008 362/235
2012/0033419 A1 * 2/2012 Kim ..... F21S 8/026 362/235
2013/0088849 A1 * 4/2013 Lee ..... F21V 29/713 362/84

FOREIGN PATENT DOCUMENTS

KR 10-1340411 B1 12/2013
KR 101340411 B1 12/2013
KR 10-1554507 B1 9/2015
KR 101554507 B1 9/2015
KR 10-2016-0049363 A 5/2016

* cited by examiner

LED LIGHTING APPARATUS HAVING NATURAL CONVECTION-TYPE HEAT DISSIPATION STRUCTURE

CROSS REFERENCE TO RELATED APPLICATION

The present application claims priority to Korean Patent Application No. 10-2017-0009996, filed Jan. 20, 2017, the entire contents of which is incorporated herein for all purposes by this reference.

BACKGROUND OF THE INVENTION

Field of the Invention

The present invention generally relates to an LED lighting apparatus having a natural convection-type heat dissipation structure. More particularly, the present invention relates to an LED lighting apparatus having a natural convection-type heat dissipation structure capable of increasing heat dissipation efficiency by causing natural convection that is a mechanism in which air surrounding a light emitting diode (LED) device receives heat, becomes less dense, and rises, and the surrounding cooler air then moves to replace it.

Description of the Related Art

Generally, a light emitting diode (LED) device that constitutes an LED lighting apparatus emits light when it is supplied with electric energy. At this point, the LED device also generates a large amount of heat. The heat generated by an LED device during its operation deteriorates performance of the LED device. Therefore, an LED lighting apparatus using an LED device needs to be designed such that it can sufficiently release its heat into the air, which enhances reliability of the LED lighting apparatus.

Heat release is performed such that the heat of an LED device is transferred to a heat dissipating member via a PCB through thermal conduction, the transferred heat is released into the air from the heat dissipating member through thermal radiation, and finally the released heat disperses in the air through convection. Thermal energy is always transferred from a high temperature side to a lower temperature side. The larger the temperature difference, the more effective the heat transfer is. Therefore, when the temperature difference is increased, the heat released into the air through thermal radiation can be rapidly convected and dispersed.

Methods of dissipating heat of an LED lighting apparatus via a heat sink are classified into passive cooling and active cooling.

Passive cooling is dominantly used for heat dissipation of LED lighting apparatuses. This dissipates heat based on principles of thermal conduction and radiation from a heat source and through natural convection.

Active cooling is a method of causing forced convection using a fan, which is driven by an electric motor, or membrane attached to a heat sink. That is, active cooling disperses hot air by force by inducing forced convection to continuously supply cooler air to a heat source.

Active cooling using forced convection is advantageous in terms of excellent heat dissipation efficiency. However, it suffers problems such as frequent malfunctioning and a short lifespan of a fan attributable to friction and wear, and it requires additional accessories such as an electric motor (or membrane) for driving the fan, which increases cost. For this reason, active cooling is rarely used for heat dissipation of LED lighting apparatuses.

Meanwhile, as to passive cooling that is a dominant cooling method for LED lighting apparatuses, since it has lower heat dissipation efficiency than active cooling, it is required to have a structure that can effectively dissipate heat to increase heat dissipation efficiency. That is, it is necessary that an outer casing of an LED lighting apparatus be made of a thermally conductive, metallic material or an additional heat-dissipating member be attached to an LED lighting apparatus to form a heat dissipative structure.

For example, as shown in FIG. 1A, a lighting apparatus is shaped in the form of a heat sink 10 provided with a plurality of heat dissipation fins and is produced through die casting. Alternatively, as shown in FIG. 1B, an aluminum heat sink 10 with a plurality of heat dissipation fins, produced through extrusion molding, is attached to a lighting apparatus, thereby increasing a surface area that is in contact with air to increase an amount of heat released into the air through thermal radiation. Further alternatively, as shown in FIG. 1C, a heat sink in which a plurality of sheet-metal heat dissipation fins is inserted into slots to be assembled with each other is added to a lighting apparatus.

However, the above-described passive cooling methods are problematic in that manufacturing of a heat sink equipped with a plurality of heat dissipation fins increases the cost of a lighting apparatus because the cost includes cost for component parts, cost for molds, and cost for assembling. Furthermore, due to a heat sink attached to a lighting apparatus, the lighting apparatus inevitably becomes complicated, larger, and heavier.

Therefore, there is a strong demand for development of an LED lighting apparatus having a novel heat-dissipating structure that can provide heat dissipation efficiency as high as that of an active cooling system while having an inexpensive, lightweight, and simple structure.

The foregoing is intended merely to aid in the understanding of the background of the present invention, and is not intended to mean that the present invention falls within the purview of the related art that is already known to those skilled in the art.

DOCUMENTS OF RELATED ART

Patent Document (Patent Document 1) Korean Patent No. 10-1554507 (Sep. 15, 2015)

(Patent Document 2) Korean Patent No. 10-1340411 (Dec. 13, 2013)

SUMMARY OF THE INVENTION

Accordingly, the present invention has been made keeping in mind the above problems occurring in the prior art, and an object of the present invention is to provide an LED lighting apparatus having a natural convection-type heat dissipation structure, the apparatus including: a printed circuit board (PCB) on which a light emitting diode (LED) device is mounted; and a heat sink coupled to a back surface of the PCB, absorbing heat generated by the LED device, and having a convection hole at a center portion thereof, the convection hole causing natural convection such that hot air surrounding the LED device rises and the surrounding cooler air moves to around the LED device to replace the hot air, thereby dramatically increasing heat dissipation efficiency.

Another object of the present invention is to provide an LED lighting apparatus having a natural convection-type heat dissipation structure that can reduce manufacturing cost, saves maintenance cost, has a simple and lightweight structure, and enables easy installation and use.

In order to accomplish the above object, according to one aspect, the present invention provides an LED lighting apparatus having a natural convection-type heat dissipation structure, the apparatus including a heat sink coupled to a back surface of a PCB to which a plurality of light emitting diode (LED) devices is mounted, the heat sink absorbing heat radiated from the LED devices, wherein center portions of the heat sink and the PCB are provided with openings serving as a convection hole that induces natural convection such that hot air under the heat sink rises along with hot air heated by heat radiated from an upper surface of the heat sink, and surrounding cooler air is supplied to the upper surface of the heat sink and to around the LED devices.

In the LED lighting apparatus, a periphery portion of the heat sink is bent in an obliquely downward direction, so that hot air more easily gathers under the heat sink than a region surrounding the heat sink.

A cover for protecting the LED devices and the PCB is coupled to a lower surface of the heat sink, the cover is made of a lens material or a light-transmitting material, and a center portion of the cover is provided with an opening serving as the convection hole.

A power supply block for supplying electric power to the LED devices is mounted on the upper surface of the heat sink, in which the power supply block is installed not to block the convection hole.

An angle-adjustable installation bracket is coupled to an upper surface of the power supply block, and a plurality of heat dissipation fins is arranged at regular intervals on the upper surface of the heat sink.

According to another aspect, there is provided an LED lighting apparatus having a natural convection-type heat dissipation structure, the apparatus including: a printed circuit board (PCB) provided with a first convection hole at a center portion thereof; a plurality of light emitting diode (LED) devices mounted to one surface of the PCB; and a heat sink coupled to a back surface of the PCB and absorbing heat radiated from the LED devices, the heat sink being provided with a second convection hole corresponding to the first convection hole at a center portion thereof, wherein the first and second convection holes of the heat sink and the PCB cause natural convection such that hot air surrounding the LED devices rises along with hot air heated by heat radiated from an upper surface of the heat sink, and cooler air is supplied to the upper surface of the heat sink and to around the LED devices.

The heat sink includes: an upper end portion having a flat plate shape so that the upper end portion is in surface contact with the PCB having a flat plate shape; and a periphery portion that is obliquely bent downward from an edge of the upper end portion, thereby forming a truncated cone shape.

The upper end portion of the heat sink and the PCB are coupled to each other by a bolt.

A cover made of a light-transmitting material and functioning to protect the LED devices and the PCB is coupled to a lower surface of the heat sink, wherein a center portion of the cover is provided with a third convection hole corresponding to the first convection hole of the PCB. In addition, an inner bottom surface of the cover is provided with a plurality of light-transmitting holders configured to accommodate the respective LED devices mounted to the PCB.

The inner bottom surface of the cover is provided with a plurality of bolt holes arranged at regular intervals, and bolts, sequentially passing through the upper end portion of the heat sink and the PCB, are inserted into the bolt holes, thereby coupling the heat sink, the PCB, and the cover to each other.

The inner bottom surface of the cover is provided with a plurality of hook-shaped protrusions arranged at regular intervals, the lower surface of the heat sink is provided with a plurality of cavities into which the hook-shaped protrusions are inserted, and the cover is coupled to the lower surface of the heat sink through engagement of the hook-shaped protrusions and the cavities.

A power supply block for supplying electric power to the LED devices is mounted on the upper surface of the heat sink, the power supply block has a width smaller than a size of the convection hole such that the power supply block crosses over a center portion of the convection hole without completely blocking the convection hole, side end portions of the power supply block are bent downward such that a lower surface of the power supply block is spaced from the convection hole, and the side end portions, which are bent downward, are coupled to the upper surface of the heat sink.

The side end portions of the power supply block are provided with respective fixing members and an installation bracket is connected to the fixing members by hinges.

A plurality of holes is arranged around the hinge to adjust an angle of the installation bracket, the fixing member is provided with a fixing protrusion that is to be selectively inserted into one of the holes, and the angle of the installation bracket is adjusted according to a position of the hole into which the fixing protrusion is inserted.

The fixing protrusion is installed in a recess formed in the fixing member and elastically supported by a spring in the recess, wherein the fixing protrusion is buried in the recess when external force is applied to the fixing protrusion but protrudes outward from a surface of the fixing member when the external force is removed.

On the upper surface of the heat sink, a plurality of heat dissipation fins for dissipating heat radiated from the upper surface of the heat sink is arranged, wherein the heat dissipation fins vary in height such that the height increases toward a center portion of the upper surface of the heat sink from respective periphery portions of the upper surface of the heat sink, and thus the heat dissipation fins are arranged to form an overall dome shape.

According to the present invention, the PCB having the LED devices mounted thereon, and the heat sink are provided with respective openings, serving as a convection hole, at their center thereof. The convection hole causes natural convection such that hot air surrounding the LED devices rises along with hot air heated by heat radiated from an upper surface of the heat sink, and cooler air is supplied to the upper surface of the heat sink and to around the LED devices. Therefore, the LED lighting apparatus of the present invention provides as a heat dissipation effect as high as that of active cooling.

In addition, manufacturing cost is reduced because additional driving devices for cooling, such as an electric motor or membrane, are not required, and maintenance cost is also reduced because there is no problem such as wearing or malfunctioning of a fan.

In addition, costs for component parts, molds, and assembling are reduced because the LED lighting apparatus of the present invention does not require an additional complicated heat dissipation member as with a passive cooling system. Furthermore, since the LED lighting apparatus of the present invention has a simple and lightweight structure, it can be easily and conveniently used.

In addition, when hot air in the truncated cone-shaped heat sink rises and escapes from the heat sink through the convection hole, the pressure in the truncated cone-shaped heat sink is lowered and thus the surrounding air with relatively higher pressure is introduced into the truncated cone-shaped heat sink. This increases heat dissipation efficiency and improves performance of the LED lighting apparatus.

In addition, the multiple heat dissipation fins provided to the upper surface of the heat sink further improves heat dissipation efficiency, and the angle-adjustable installation bracket enables easy installation and increases commercial value of products.

BRIEF DESCRIPTION OF THE DRAWINGS

The above and other objects, features and other advantages of the present invention will be more clearly understood from the following detailed description when taken in conjunction with the accompanying drawings, in which:

FIG. 8A and FIG. 8B are conceptual diagrams showing the concept of air circulation through thermal convection, wherein FIG. 8A shows an event in which hot air under the heat sink rises through a convection hole along with hot air heated by heat radiated from an upper surface of the heat sink, and FIG. 8B shows an event in which cooler air is supplied to replace the hot air under the heat sink.

DETAILED DESCRIPTION OF THE INVENTION

Figure 1A:
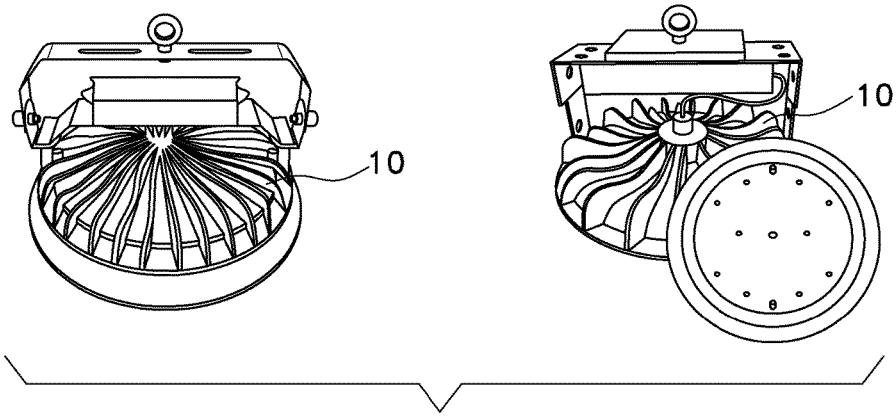
FIG. 1A, FIG. 1B, and FIG. 1C are perspective views illustrating examples of a heat sink attached to a conventional LED lighting apparatus having a passive cooling system.
Figure 1B:
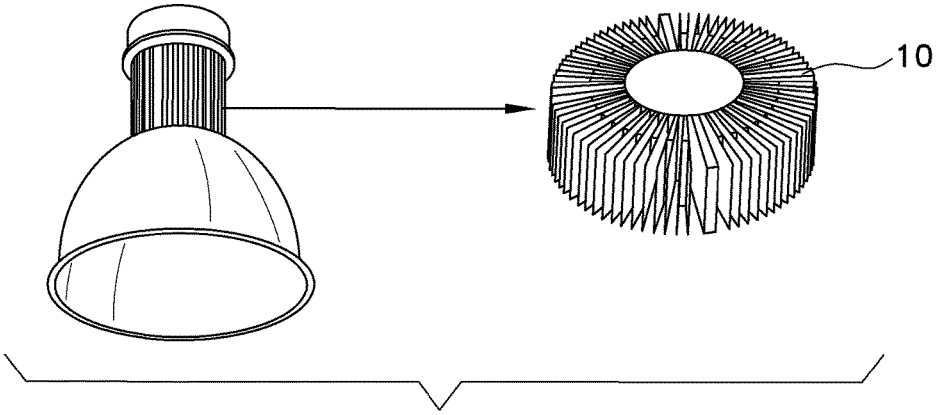
Figure 1C:
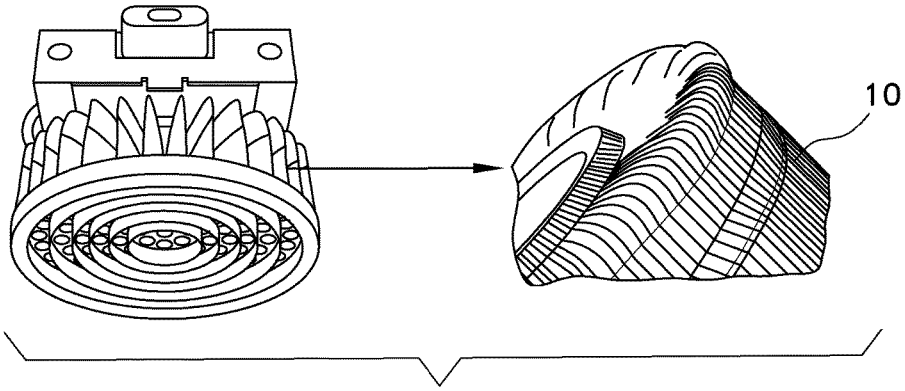
Figure 2:
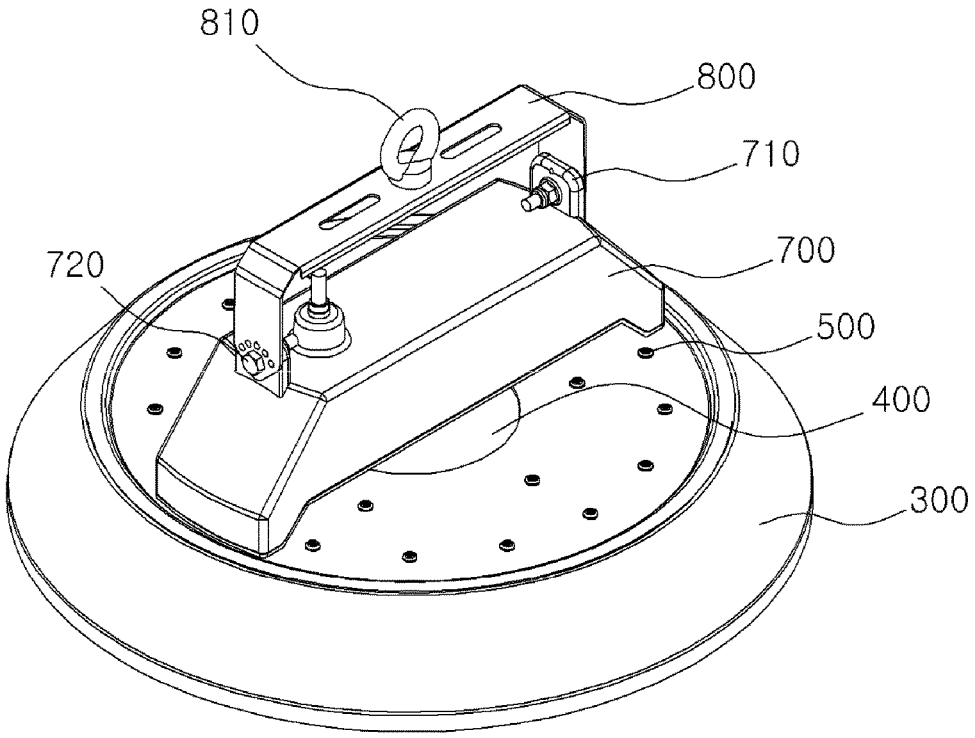
FIG. 2 is a top perspective view of an LED lighting apparatus having a natural convection-type heat dissipation structure according to one embodiment of the present invention.
Figure 3:
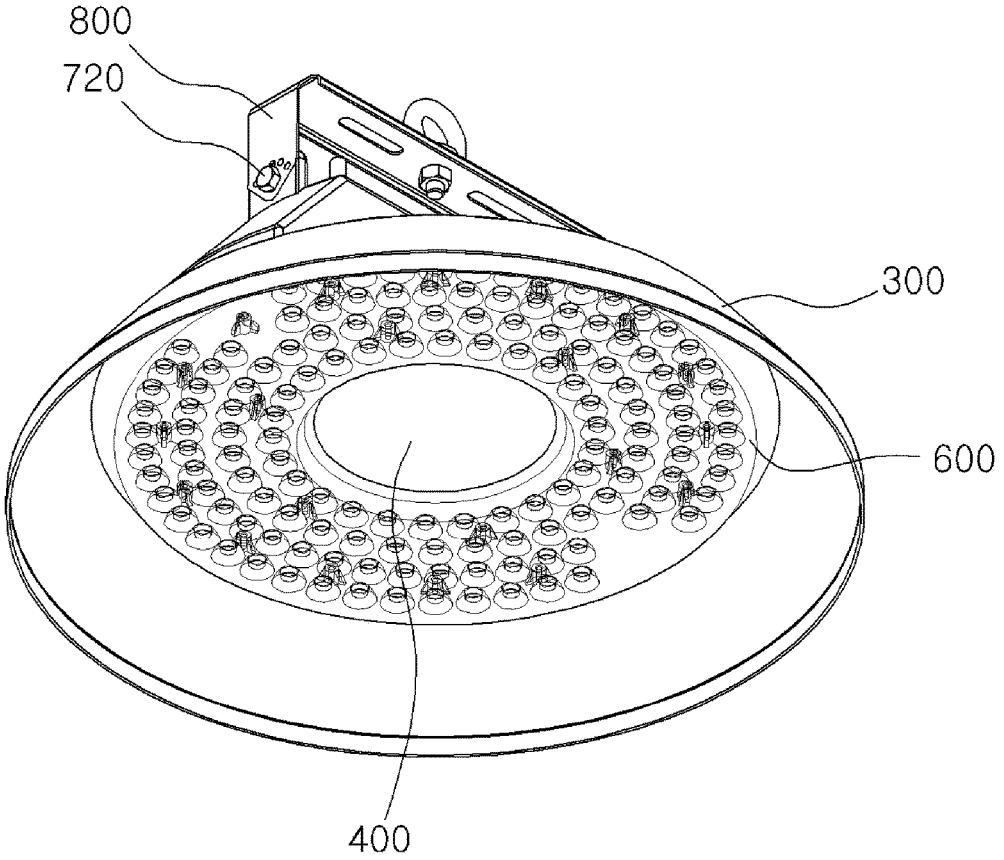
FIG. 3 is a bottom perspective view of the LED lighting apparatus according to the embodiment of the present invention.

Advantages and features of the present invention and methods for accomplishing them will be clearly understood with reference to the accompanying drawings and exemplary embodiments described below. Hereinafter, an LED lighting apparatus having a natural convection-type heat dissipation structure according to one embodiment of the present invention will be described in detail with reference to the accompanying drawings. Unless otherwise defined, throughout the drawings, the same reference numerals will refer to the same or like parts.

Figure 6:
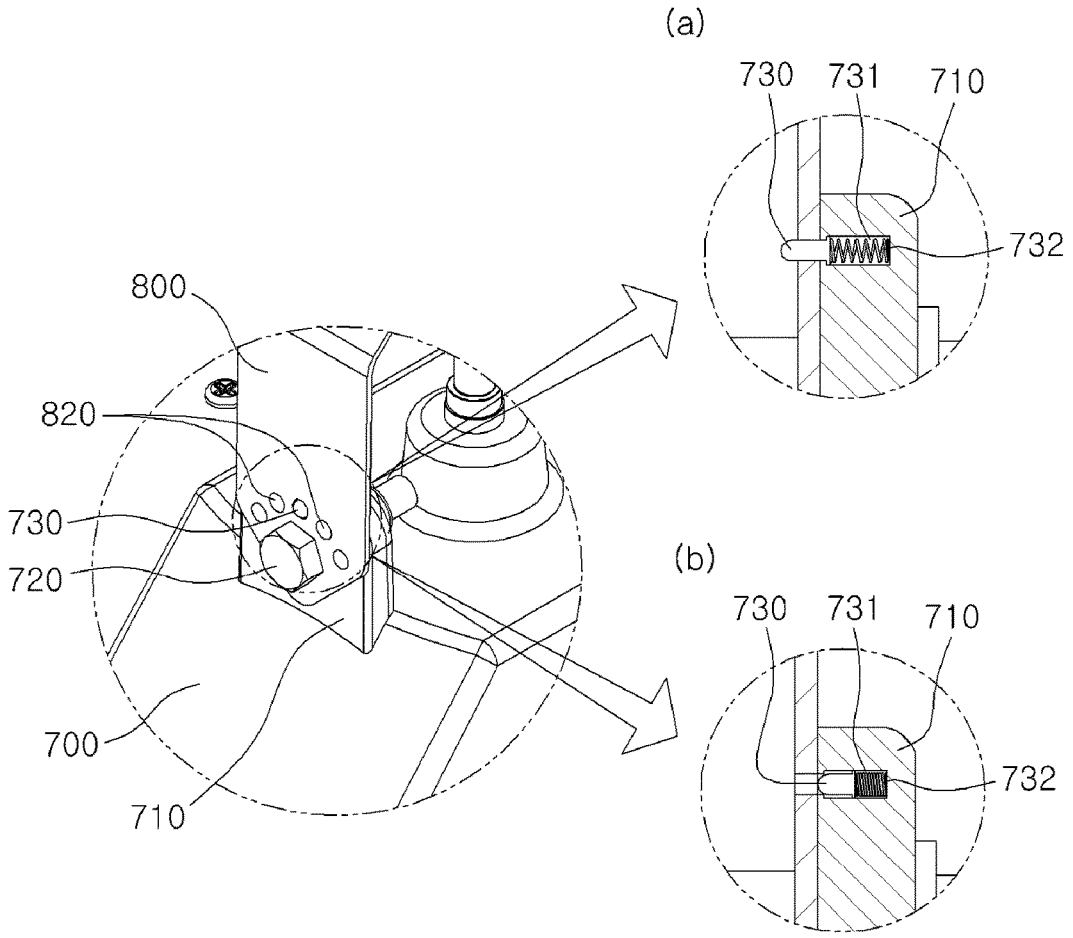
FIG. 6 is an enlarged view showing a main portion of a connection structure of an angle-adjustable installation bracket attached to a power case.
Figure 7:
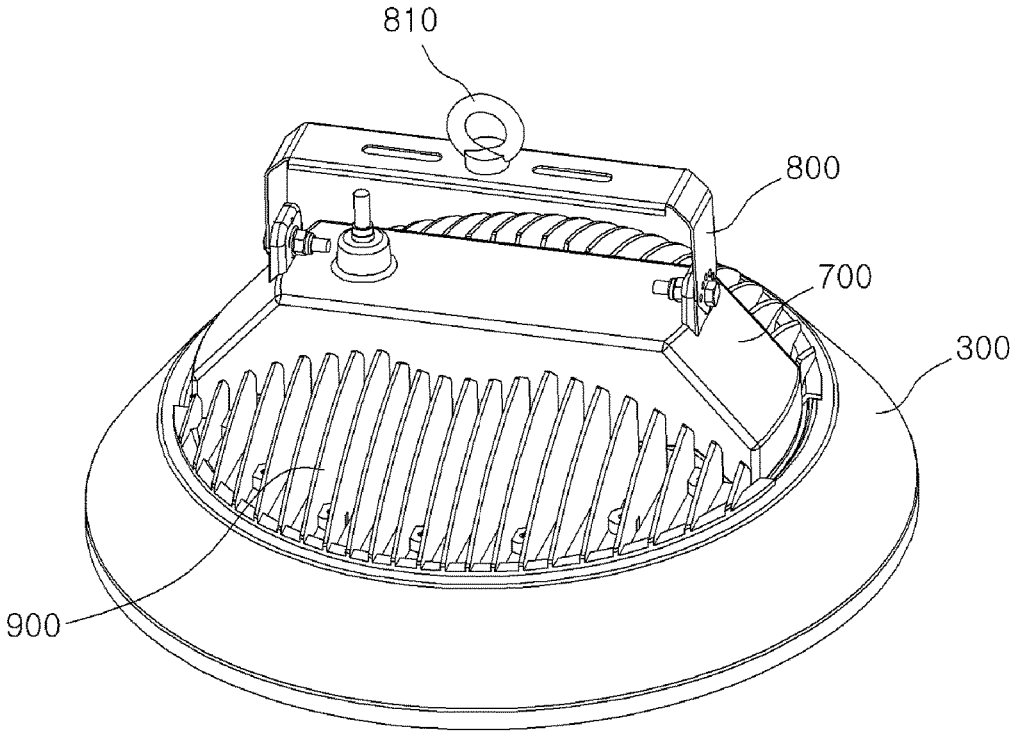
FIG. 7 is a perspective view showing a plurality of heat dissipation fins arranged at regular intervals on an upper surface of a heat sink in the LED lighting apparatus according to the embodiment of the present invention.

With reference to FIGS. 2 to 5, the construction and relationship of component parts of an LED lighting apparatus having a natural convection-type heat dissipation structure according to one embodiment of the present invention will be described. With reference to FIG. 6, an angle adjusting structure for adjusting the angle of an installation bracket will be described. With reference to FIG. 7, heat dissipation fins provided to an upper surface of a heat sink will be described. With reference to FIG. 8, a function of a convection hole that induces air circulation and natural convection will be described.

As shown in FIGS. 2 to 5, according to one embodiment of the present invention, an LED lighting apparatus having a natural convection-type heat dissipation structure includes a printed circuit board (PCB) 100, a plurality of light emitting diode (LED) devices 200, and a heat sink 300.

The PCB 100 is a doughnut-shaped board having a first convection hole 400*a* at a center portion thereof.

The LED devices 200 are mounted and arranged on a surface of the PCB 100 provided with the first convection hole 400*a*.

The heat sink 300 for absorbing heat radiated from the LED devices 200 is attached to a back surface of the PCB 100.

An upper end portion of the heat sink 300 has a flat plate shape as with the PCB 100 so that the heat sink 300 can be in surface contact with the PCB 100. A center portion of the flat plate portion (i.e. upper end portion) of the heat sink 300 is provided with a second convection hole 400*b* that is coaxially aligned with the first convection hole 400*a* and has a similar size to the first convection hole 400*a*. A periphery portion of the heat sink 300 extending from the flat plate portion (upper end portion) is obliquely bent downward, thereby having an inclined surface.

The heat sink 300 is made of a metal with high thermal conductivity so that heat generated by the LED devices 200 can be effectively released into the air.

The upper end portion of the heat sink 300 and the PCB 100 are provided with coupling holes 310 and 110 that are through holes arranged between the LED devices 200, and the heat sink and 200 the PCB 100 are coupled to each other by bolts 500 inserted to pass through the coupling holes 310 and 110.

A cover 600 for protecting the LED devices 200 and the PCB 100 is attached to a lower surface of the heat sink 300.

The cover 600 is made of a lens material or a light-transmitting material so that light emitted from the LED devices 200 can pass through the cover 600. The cover 600 has a third convection hole 400*c* at a center portion thereof. The third convection hole 300*c* and the first convection hole 400*a* are coaxially formed.

The first convection hole 400*a* of the PCB, the second convection hole 400*b* of the heat sink, and the third convection hole 400*c* of the cover are collectively referred to as a convection hole 400.

An inner bottom surface of the cover 600 may be provided with light-transmitting holders 610 configured to accommodate the respective LED devices 200 mounted on the surface of the PCB 100. The light-transmitting holders 610 may be integrally formed with the inner bottom surface of the cover 600 through a molding process.

The inner bottom surface of the cover 600 is provided with bolt holes 620 corresponding to the coupling holes 310 and 110 formed in the heat sink and the PCB. The bolt holes 620 are used to couple the cover 600 to the lower surface of the heat sink 300. Bolts 500, which are inserted to pass through the upper end portion of the heat sink 300 and the PCB 100, are inserted into the bolt holes 620. In this way, the heat sink 300, the PCB 100, and the cover 600 are combined with each other by the bolts 500. The bolts 500 do not pass through the cover 600. That is, tips of the bolts 500 do not protrude from an outer bottom surface of the cover 600 but are received within the bolt holes 620.

In addition, although not illustrated in the drawings, the inner bottom surface of the cover is provided with hook-shaped protrusions and the lower surface of the heat sink is provided with cavities into which the hook-shaped protrusions can be inserted. Thus, the cover can be easily coupled to the lower surface of the heat sink in a manner of inserting the hook-shaped protrusions into the respective cavities. In this case, the PCB may be provided with through holes at positions corresponding to the hook-shaped protrusions and the cavities.

In addition, a power supply block 700 for supplying electric power to the LED devices 200 is mounted on the upper surface of the heat sink 300. The power supply block 700 is mounted not to completely block the convection hole 400 formed in the heat sink 300.

The power supply block 700 has a width smaller than the size of the convection hole 400 so that it does not completely block the convection hole 400 while it crosses over the center of the convection hole 400. Side end portions of the power supply block 700 are obliquely bent downward and are attached to the upper surface of the heat sink 300. Therefore, the bottom surface of most of the power supply block 600 is spaced from the convection hole 400. That is, the power supply block 700 has a width smaller than the size of the convection hole 400 and is structured to provide a space between itself and the convection hole 400, thereby not blocking the convection hole 400 and thus allowing air to freely move through the convection hole 400.

In addition, an installation bracket 800 is coupled to an upper surface of the power supply block 700.

To couple the installation bracket 800 to the power supply block 700, fixing members 710 are provided to respective end portions of the upper surface of the power supply block 700, and respective ends of the installation bracket 800 are connected to the fixing members 710 by hinges 720 so that the installation bracket 800 can be rotated from side to side. In addition, a ring-shaped member 810 may be coupled to a middle portion of the installation bracket 800 as necessary.

Figure 4:
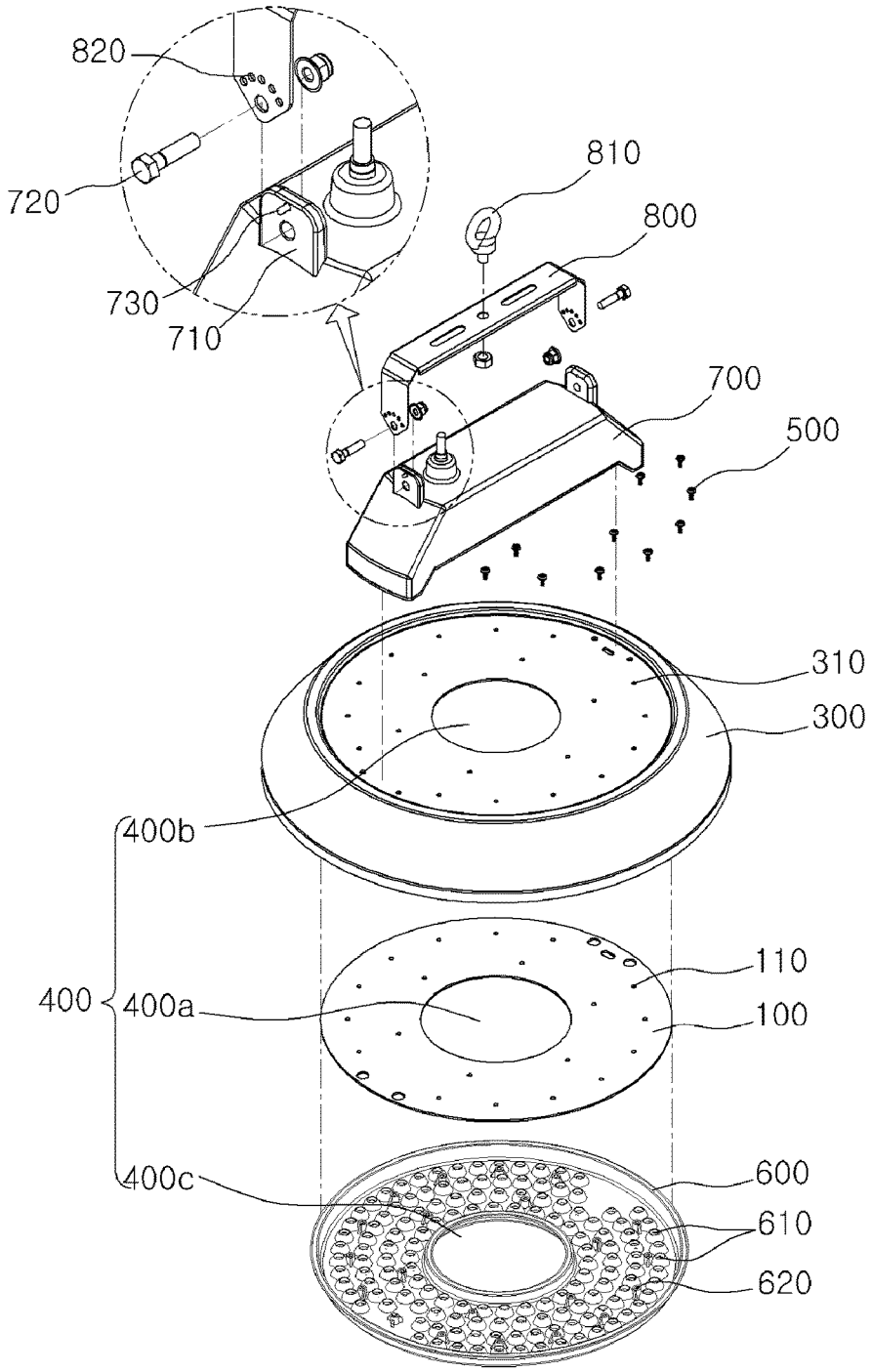
FIG. 4 is an exploded perspective view of the LED lighting apparatus according to the embodiment of the present invention.
Figure 5:
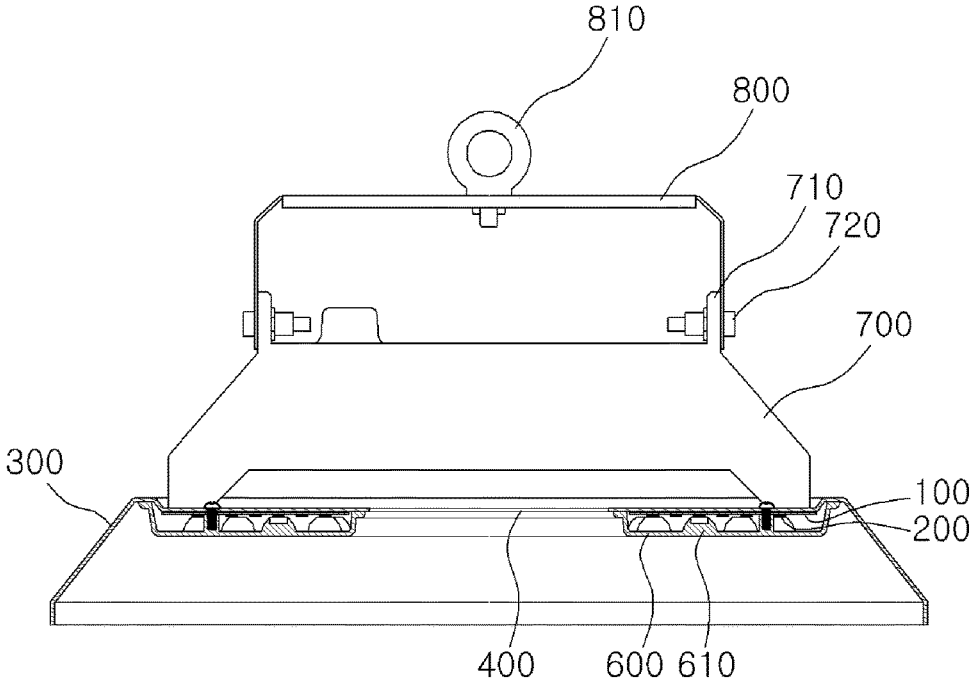
FIG. 5 is an assembled perspective view of the LED lighting apparatus according to the embodiment of the present invention.

In addition, as illustrated in FIG. 4 and FIG. 6, the respective side surfaces of the installation bracket 800 are provided with a plurality of holes 820 that is arranged around the hinge 720. The fixing members 710 are provided with a fixing protrusion 730 to be inserted into one of the holes 820. With this structure, a rotation angle of the installation brackets 800 can be adjusted according the position of the hole 820 into which the fixing protrusion 730 is inserted.

The fixing protrusion 730 is elastically supported by a spring 731 in a recess 731 formed in the fixing member 710. Therefore, the fixing protrusion 730 becomes buried in the recess 731 when external force is applied thereto, but is sprung back from the recess 731 when the external force is removed.

When external force is applied to the fixing protrusion 730, the fixing protrusion 730 retracts into the recess 731 and thus is not present in the hole 820. In this state, the angle of the installation bracket 800 can be adjusted. After that, the fixing protrusion 730 comes out to be positioned in the selected hole 820 and the external force is removed. In this state, since the fixing protrusion 730 is positioned in the selected hole 820, the angle of the installation bracket 800 is fixed.

In this way, the angle of the installation bracket 800 can be freely and conveniently adjusted using the fixing protrusion 730 that can be selectively inserted into one of the multiple holes 820 arranged along a rotation radius about the hinge.

In addition, as shown in FIG. FIG. 7, the upper surface of the heat sink 300 may be provided with a plurality of heat dissipation fins 900 for dissipating radiant heat.

The heat dissipation fins 900 are arranged on left and right sides of the power supply block 700 that crosses over the center of the heat sink 300. The heat dissipation fins 900 are arranged not to block the convection hole 400 of the heat sink 300.

Each heat dissipation fin 900 has a plate shape to increase a surface area in contact with air. The plate-shaped heat dissipation fins 900 vary in height and the plate-shaped heat dissipation fins 900 are arranged such that the height increases toward the center of the upper surface of the heat sink from periphery portions of the upper surface of the heat sink, thereby forming an overall dome shape. The shape and height of the heat dissipation fins 900 are not limited to the plate shape and the dome shape but can be changed diversely.

Operation of the LED lighting apparatus having the above structure will be described below.

Figure 8A:
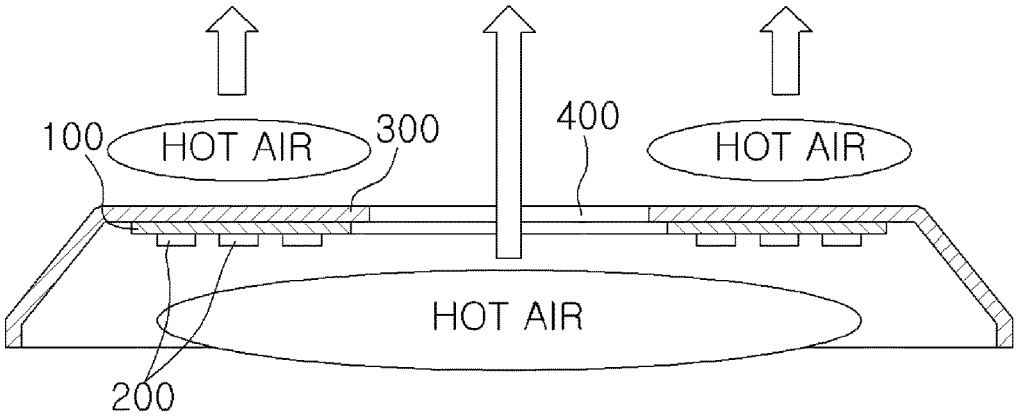

As shown in FIG. 8A, when the LED devices 200 are powered, the powered LED devices 200 emit light and heat.

The heat is conducted to the heat sink 300 via the PCB 100 and raises ambient temperature around the LED devices 200. That is, air surrounding the LED devices 200 is heated due to the heat generated by the LED devices 200, and the heated air stays in the truncated cone-shaped heat sink 300. Thus, heat is also radiated from the upper surface of the heat sink 300.

The hot air in the truncated cone-shaped heat sink 300 rises and escapes from the heat sink 300 through the convection hole 400. Meanwhile, hot air on the upper surface of the heat sink, attributed to heat radiated from the upper surface of the heat sink, also rises.

Thus, air in regions where the hot air has left, i.e. a region near the upper surface of the heat sink 300 and a region around the LED devices becomes less dense, resulting in low pressure. Therefore, the surrounding cooler is introduced into the lower pressure regions.

Figure 8B:
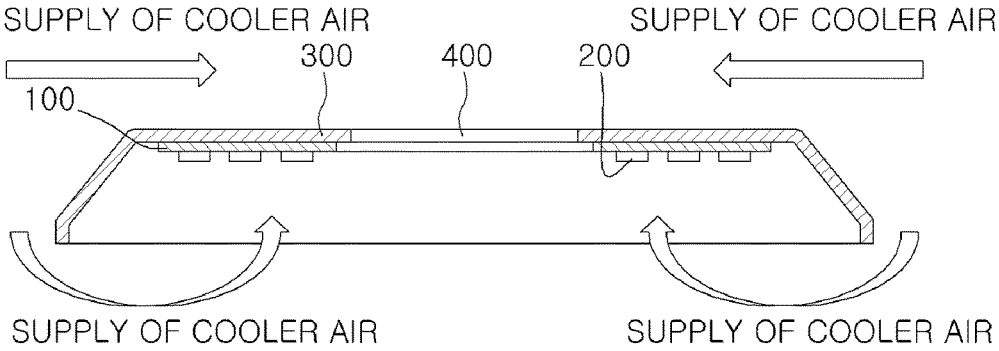

As shown in FIG. 8B, the hot air in the heat sink 300 rises and escapes from the heat sink 300 through the convection hole 400, and thus the pressure in the truncated cone-shaped portion of the heat sink 300 is lowered and the surrounding cooler air of relatively higher pressure is introduced into the truncated cone-shaped portion of the heat sink 300 that is in a relatively lower pressure state.

The cooler air introduced into the truncated cone-shaped portion of the heat sink 300 is heated by the heat generated by the LED devices, and thus becomes hot air. The hot air rises and escapes from the heat sink through the convection hole 400, and the surrounding cooler air is introduced into the heat sink 300 to replace the hot air that has escaped. In this way, air circulation occurs.

Air flows from a higher temperature side to a lower temperature side and from a higher pressure side to a lower pressure side. During air circulation, the convection hole 400 formed at the center of the heat sink induces natural convection such that hot air rises and escapes from the heat sink and cooler air is continuously supplied to around the LED devices 200.

EXAMPLES

Hereinafter, the results of temperature comparison between an LED lighting apparatus of a comparative example and an LED lighting apparatus of the preferred embodiment will be described. For this experiment, an LED lighting apparatus (comparative example) equipped with a heat sink having no convection hole and an LED lighting apparatus (preferred embodiment) equipped with a heat sink provided with a convection hole are manufactured, and their temperatures are measured.

Comparative Example

A truncated cone-shaped heat sink for absorbing heat is coupled to a back surface of a PCB to which a plurality of LED devices is mounted, in which the PCB and the heat sink are not provided with a convection hole.

Preferred Embodiment

A truncated cone-shaped heat sink for absorbing heat is coupled to a back surface of a PCB to which a plurality of LED devices is mounted, in which center portions of the PCB and the heat sink are provided with a convection hole.

(Experiment)

In the comparative example and the preferred embodiment, the LED devices that are mounted are the same kind. In addition, the LED lighting apparatuses according to the comparative example and the preferred embodiment were turned on for a predetermined period of time under the same conditions, and temperatures were measured at the upper surfaces of the LED lighting apparatuses. The measured temperatures are shown in Table 1.

TABLE 1

| Items | Temperature of LED device 1 | Temperature of LED device 2 | Temperature of LED device 3 | Temperature at upper end of heat sink |
|---|---|---|---|---|
| Comparative example (LED lighting apparatus having heat sink with no convection hole) | 51.5□ | 52.2□ | 50.6.□ | 51.4□ |
| Embodiment (LED lighting apparatus having heat sink with convection hole) | 44.1□ | 44.7□ | 43.1□ | 43.7□ |
| Temperature difference | 7.4□ | 7.5□ | 7.5□ | 7.7□ |

As shown in Table 1, for the LED lighting apparatus of the comparative example, the temperatures of an LED device 1, an LED device 2, and an LED device 3 were respectively 51.5° C., 52.2° C., 50.6° C., and the temperature on the upper surface of the heat sink was 51.4° C. That is, all the measured temperatures exceeded 50° C. Meanwhile, for the LED lighting apparatus of the preferred embodiment, the temperatures of an LED device 1, an LED device 2, and an LED device 3 were respectively 44.1° C., 44.7° C., and 43.1° C., and the temperature on the upper surface of the heat sink was 43.7° C.

That is, the temperatures of the preferred embodiment (LED lighting apparatus having a heat sink with a convection hole) were 7.4° C. to 7.7° C. lower than the temperatures of the comparative example (LED lighting apparatus having a heat sink with no convection hole). Thus, the temperature decreasing effect is confirmed.

Therefore, according to the present invention, with the structure in which the PCB, to which LED devices are mounted, and the heat sink are provided with convection holes at their center, it is possible to cause natural convection such that hot air around the LED devices rises along with hot air heated by radiant heat on the upper surface of the heat sink and the surrounding cooler air is supplied to the upper surface of the heat sink and to around the LED devices. Thus, the LED lighting apparatus of the present invention provides a heat dissipation effect as high as that of an active cooling system.

In addition, since additional driving devices for cooling, such as an electric motor or membrane, which are necessary for active cooling, are not required in the present invention, manufacturing cost is reduced. Furthermore, since the LED lighting apparatus of the present invention is free from fan-related problems such as wearing and malfunctioning, maintenance cost is also reduced.

In addition, a complicated heat sink that is usually used for passive cooling is not required in the present invention. Therefore, according to the present invention, costs for component parts, molds, and assembling procedures can be reduced. Furthermore, since the LED lighting apparatus has a simple and lightweight structure, usability and practicality of the apparatus are improved.

In addition, since hot air surrounding LED devices effectively gathers in the truncated cone-shaped heat sink and the gathered air can escape through the convection hole, low pressure is induced within the truncated cone-shaped heat sink, and the surrounding cooler air outside the heat sink can be easily introduced into the heat sink. For this reason, heat dissipation efficiency is increased.

In addition, since the upper end portion of the heat sink is provided with multiple heat dissipation fins, the heat radiated from the upper surface of the heat sink can be rapidly dissipated. This further increases heat dissipation efficiency.

In addition, since the installation bracket has a structure in which its angle can be freely adjusted, the LED lighting apparatus can be easily installed.

Although a preferred embodiment of the present invention has been described for illustrative purposes, those skilled in the art will appreciate that the present invention is not limited to the preferred embodiment but various modifications, additions and substitutions are possible, without departing from the scope and spirit of the invention as disclosed in the accompanying claims.

The invention claimed is:

1. An LED lighting apparatus having a natural convection-type heat dissipation structure, the LED lighting apparatus comprising:

a heat sink coupled to a back surface of a PCB to which a plurality of light emitting diode (LED) devices is mounted, the heat sink absorbing heat radiated from the LED devices, wherein center portions of the heat sink and the PCB are provided with respective openings serving as a convection hole that induces natural convection such that hot air under the heat sink rises along with hot air heated by heat radiated from an upper surface of the heat sink, and surrounding cooler air is supplied to the upper surface of the heat sink and to around the LED devices, wherein a power supply block for supplying electric power to the LED devices is mounted on an upper surface of the heat sink, the power supply block has a width smaller than a size of the convection hole such that the power supply block crosses over a center portion of the convection hole without completely blocking the convection hole, side end portions of the power supply block are bent downward such that a lower surface of the power supply block is spaced from the convection hole, and the side end portions, which are bent downward, are coupled to the upper surface of the heat sink, wherein the side end portions of the power supply block are provided with respective fixing members, and an installation bracket is connected to the fixing members by hinges.

2. The LED lighting apparatus according to claim 1, wherein a periphery portion of the heat sink is bent in an obliquely downward direction, so that hot air more easily gathers under the heat sink than a region surrounding the heat sink.

3. The LED lighting apparatus according to claim 1, wherein a cover for protecting the LED devices and the PCB is coupled to a lower surface of the heat sink.

4. The LED lighting apparatus according to claim 3, wherein the cover is made of a lens material or a light-transmitting material, and a center portion of the cover is provided with an opening serving as the convection hole.

5. The LED lighting apparatus according to claim 1, wherein an angle-adjustable installation bracket is coupled to an upper surface of the power supply block.

6. The LED lighting apparatus according to claim 1, wherein a plurality of heat dissipation fins is arranged at regular intervals on the upper surface of the heat sink.

7. The LED lighting apparatus according to claim 1, wherein a plurality of holes is arranged around the hinge to adjust an angle of the installation bracket, the fixing member is provided with a fixing protrusion that is to be selectively inserted into one of the holes, and the angle of the installation bracket is adjusted according to a position of the hole into which the fixing protrusion is inserted.

8. The LED lighting apparatus according to claim 7, wherein the fixing protrusion is installed in a recess formed in the fixing member and elastically supported by a spring in the recess, and wherein the fixing protrusion is buried in the recess when external force is applied to the fixing protrusion but protrudes outward from a surface of the fixing member when the external force is removed.

9. An LED lighting apparatus having a natural convection-type heat dissipation structure, the LED lighting apparatus comprising:

a printed circuit board (PCB) provided with a first convection hole at a center portion thereof;

a plurality of light emitting diode (LED) devices mounted to one surface of the PCB; and a heat sink coupled to a back surface of the PCB and absorbing heat radiated from the LED devices, the heat sink being provided with a second convection hole corresponding to the first convection hole at a center portion thereof;

wherein the first and second convection holes of the heat sink and the PCB cause natural convection such that hot air surrounding the LED devices rises along with hot air heated by heat radiated from an upper surface of the heat sink, and cooler air is supplied to the upper surface of the heat sink and to around the LED devices, wherein a power supply block for supplying electric power to the LED devices is mounted on the upper surface of the heat sink, the power supply block has a width smaller than a size of the convection hole such that the power supply block crosses over a center portion of the convection hole without completely blocking the convection hole, side end portions of the power supply block are bent downward such that a lower surface of the power supply block is spaced from the convection hole, and the side end portions, which are bent downward, are coupled to the upper surface of the heat sink, wherein the side end portions of the power supply block are provided with respective fixing members, and an installation bracket is connected to the fixing members by hinges.

10. The LED lighting apparatus according to claim 9, wherein the heat sink includes:

an upper end portion having a flat plate shape so that the upper end portion is in surface contact with the PCB having a flat plate shape; and a periphery portion that is obliquely bent downward from an edge of the upper end portion, thereby forming a truncated cone shape.

11. The LED lighting apparatus according to claim 9, wherein an upper end portion of the heat sink and the PCB are coupled to each other by a bolt.

12. The LED lighting apparatus according to claim 9, wherein a cover made of a light-transmitting material and functioning to protect the LED devices and the PCB is coupled to a lower surface of the heat sink, wherein a center portion of the cover is provided with a third convection hole corresponding to the first convection hole of the PCB.

13. The LED lighting apparatus according to claim 12, wherein an inner bottom surface of the cover is provided with a plurality of light-transmitting holders configured to accommodate the respective LED devices mounted to the PCB.

14. The LED lighting apparatus according to claim 12, wherein an inner bottom surface of the cover is provided with a plurality of bolt holes arranged at regular intervals, and bolts, sequentially passing through the upper end portion of the heat sink and the PCB, are inserted into the bolt holes, thereby coupling the heat sink, the PCB, and the cover to each other.

15. The LED lighting apparatus according to claim 12, wherein an inner bottom surface of the cover is provided with a plurality of hook-shaped protrusions arranged at regular intervals, the lower surface of the heat sink is provided with a plurality of cavities into which the hook-shaped protrusions are inserted, and the cover is coupled to the lower surface of the heat sink through engagement of the hook-shaped protrusions and the cavities.

16. The LED lighting apparatus according to claim 9, wherein a plurality of holes is arranged around the hinge to adjust an angle of the installation bracket, the fixing member is provided with a fixing protrusion that is to be selectively inserted into one of the holes, and the angle of the installation bracket is adjusted according to a position of the hole into which the fixing protrusion is inserted.

17. The LED lighting apparatus according to claim 16, wherein the fixing protrusion is installed in a recess formed in the fixing member and elastically supported by a spring in the recess, and wherein the fixing protrusion is buried in the recess when external force is applied to the fixing protrusion but protrudes outward from a surface of the fixing member when the external force is removed.

18. The LED lighting apparatus according to claim 9, wherein on the upper surface of the heat sink, a plurality of heat dissipation fins for dissipating heat radiated from the upper surface of the heat sink is arranged.

19. The LED lighting apparatus according to claim 18, wherein the heat dissipation fins vary in height such that the height increases toward a center portion of the upper surface from respective periphery portions of the upper surface of the heat sink, and thus the heat dissipation fins are arranged to form an overall dome shape.

* * * * *